US012669243B2

(12) United States Patent
Kovash et al.

(10) Patent No.: US 12,669,243 B2
(45) Date of Patent: Jun. 30, 2026

(54) PILOT GAS PREHEATING FOR A GAS FLARE PILOT BURNER

(71) Applicant: Steffes, LLC, Dickinson, ND (US)

(72) Inventors: Dean A. Kovash, Dickinson, ND (US); Tyson Meidinger, Dickinson, ND (US); Mackenzie J. Elmer, Dickinson, ND (US)

(73) Assignee: Steffes, LLC, Dickinson, ND (US)

( * ) Notice: Subject to any disclaimer, the term of this patent is extended or adjusted under 35 U.S.C. 154(b) by 342 days.

(21) Appl. No.: 18/447,352

(22) Filed: Aug. 10, 2023

(65) Prior Publication Data

US 2025/0052422 A1 Feb. 13, 2025

(51) Int. Cl.
*F23G 7/08* (2006.01)
*F23D 14/46* (2006.01)
*F23G 7/06* (2006.01)

(52) U.S. Cl.
CPC ..... *F23G 7/085* (2013.01); *F23D 14/46* (2013.01); *F23G 7/065* (2013.01)

(58) Field of Classification Search
CPC ..... F23G 7/085; F23G 7/065; F23D 4/46
USPC ..... 431/202, 5, 209, 247, 207
See application file for complete search history.

(56) References Cited

U.S. PATENT DOCUMENTS 1,937,974 A 12/1933 McKee
2,111,239 A * 3/1938 Elze ..... F23D 11/44 431/243
2,483,437 A 10/1949 Rizer
2,631,603 A 3/1953 Shook
2,746,061 A 5/1956 Bennett
2,802,521 A 8/1957 Campbell
2,983,312 A * 5/1961 Finley ..... F23D 14/08 431/243
2,996,155 A 8/1961 Priesemuth
D193,046 S 6/1962 Sabo
(Continued)

FOREIGN PATENT DOCUMENTS

CA 2318516 A1 8/1999
CA 2554138 A1 8/2005
(Continued)

OTHER PUBLICATIONS https://catcousa.com/browse-products/instrument-gas-heating-assemblies/2600-series-dual-coil-pilot-preheaters/dual-coil-pilot-preheater-2600-series-120v-start/.
(Continued)

*Primary Examiner* — Vivek K Shirsat
(74) *Attorney, Agent, or Firm* — Brian D. Kaul; Westman, Champlin & Koehler, P.A.

(57) ABSTRACT

A pilot burner for igniting a gas flare includes a pilot gas supply line, an inspirator, a gas feed line, a pilot output and an igniter. The pilot gas supply line is configured to receive a flow of pilot gas from a pilot gas source. The inspirator receives the flow of pilot gas from the pilot gas supply line and mixes the flow of pilot gas with air to form a mixed flow of air and gas. The gas feed line receives the mixed flow from the inspirator. The pilot output is connected to the gas feed line and discharges the mixed flow. The igniter is configured to ignite the mixed flow discharged through the pilot output to form a flame. The pilot gas supply line includes a gas preheat conduit section that is positioned adjacent to the pilot output and is configured to be heated by the flame.

13 Claims, 3 Drawing Sheets

(56) References Cited

U.S. PATENT DOCUMENTS

| | | | | |
|---|---|---|---|---|
| 3,192,900 | A | 7/1965 | Lippke | |
| 3,506,240 | A | 4/1970 | Modrin | |
| 3,547,567 | A | 12/1970 | Turpin | |
| 3,711,236 | A | 1/1973 | Kinsella et al. | |
| 3,749,546 | A | 7/1973 | Reed et al. | |
| 3,833,337 | A | 9/1974 | Desty et al. | |
| 3,840,328 | A | 10/1974 | Ashton | |
| 3,860,972 | A | 1/1975 | Costello | |
| 3,915,622 | A | 10/1975 | Desty et al. | |
| 3,972,076 | A | 8/1976 | Martini | |
| 4,021,189 | A | 5/1977 | Swann et al. | |
| 4,036,580 | A | 7/1977 | Reed | |
| 4,073,613 | A | 2/1978 | Desty | |
| 4,095,933 | A * | 6/1978 | Schumacher | F23D 14/20 431/11 |
| 4,099,908 | A | 7/1978 | Beckmann et al. | |
| 4,255,120 | A | 3/1981 | Straitz, III | |
| 4,269,583 | A | 5/1981 | Straitz, III | |
| 4,334,751 | A | 6/1982 | Jinsenji et al. | |
| 4,406,615 | A | 9/1983 | Guerra et al. | |
| 4,457,696 | A | 7/1984 | Schwartz et al. | |
| 4,486,167 | A | 12/1984 | McMurray et al. | |
| 4,486,168 | A | 12/1984 | Pratley | |
| 4,588,373 | A | 5/1986 | Tonon et al. | |
| 4,634,372 | A | 1/1987 | Allum et al. | |
| 5,277,248 | A | 1/1994 | Breland | |
| 5,307,834 | A | 5/1994 | Tatarek-Gintowt et al. | |
| 5,389,080 | A | 2/1995 | Yoon | |
| 5,429,496 | A | 7/1995 | Stephens et al. | |
| 5,803,726 | A * | 9/1998 | Bacon | F23G 7/085 431/264 |
| 5,873,712 | A | 2/1999 | Guerra | |
| 5,882,187 | A | 3/1999 | Gustafson et al. | |
| 5,997,284 | A | 12/1999 | Gustafson et al. | |
| 6,062,253 | A | 5/2000 | Hanel et al. | |
| 6,155,498 | A | 12/2000 | Yamamoto | |
| 6,431,855 | B1 | 8/2002 | Pedersen | |
| 6,616,062 | B2 | 9/2003 | Boecking | |
| 6,708,946 | B1 | 3/2004 | Edwards et al. | |
| 6,960,075 | B2 | 11/2005 | Rajewski | |
| 7,156,193 | B2 | 1/2007 | Swartout | |
| 7,328,680 | B1 | 2/2008 | Diamond | |
| 7,354,265 | B2 | 4/2008 | Mashhour et al. | |
| 7,677,883 | B2 | 3/2010 | Harless | |
| D640,363 | S | 6/2011 | Cook | |
| 7,967,600 | B2 | 6/2011 | Hong et al. | |
| 8,118,783 | B2 | 2/2012 | Smith | |
| 8,282,389 | B2 | 10/2012 | Dhulst et al. | |
| D671,204 | S | 11/2012 | Kovash et al. | |
| D684,682 | S | 6/2013 | Kovash et al. | |
| 8,967,995 | B1 | 3/2015 | Griffin et al. | |
| D777,051 | S | 1/2017 | Cotsman | |
| 9,791,067 | B2 | 10/2017 | Kovash et al. | |
| D807,478 | S | 1/2018 | Bacon | |
| 9,970,657 | B2 | 5/2018 | Kovash et al. | |
| 9,970,658 | B2 | 5/2018 | Kovash et al. | |
| D833,900 | S | 11/2018 | Kovash et al. | |
| 2002/0074423 | A1 | 6/2002 | Boecking | |
| 2006/0110272 | A1 | 5/2006 | Moore et al. | |
| 2006/0217666 | A1 | 9/2006 | Wenchell | |
| 2007/0281266 | A1 | 12/2007 | Rajewski | |
| 2008/0081304 | A1 | 4/2008 | Poe et al. | |
| 2008/0185813 | A1 | 8/2008 | Watson | |
| 2009/0233248 | A1 | 9/2009 | Dhulst et al. | |
| 2010/0206309 | A1 | 8/2010 | Han et al. | |
| 2010/0291492 | A1 | 11/2010 | Poe et al. | |
| 2012/0006091 | A1 | 1/2012 | Deng | |
| 2012/0015308 | A1 | 1/2012 | Hong et al. | |
| 2012/0255536 | A1 | 10/2012 | Deng | |
| 2012/0276488 | A1 | 11/2012 | Virag et al. | |
| 2012/0279484 | A1 | 11/2012 | Lange | |
| 2014/0130676 | A1 | 5/2014 | Daniels | |
| 2015/0153042 | A1 | 6/2015 | Kovash et al. | |
| 2015/0323177 | A1 | 11/2015 | Kovash et al. | |
| 2016/0047216 | A1 | 2/2016 | Rajewski | |
| 2022/0373176 | A1 | 11/2022 | Al-Shaiji et al. | |

FOREIGN PATENT DOCUMENTS

| | | | |
|---|---|---|---|
| EP | 0026067 | A2 | 4/1981 |
| WO | 2014113529 | A1 | 7/2014 |

OTHER PUBLICATIONS https://www.thermon.com/products/heating-systems/cata-dyne/explosion-proof-gas-catalytic-heaters/enclosure-heaters/igp-instrument-gas-preheater/.

https://bruestcatalyticheaters.com/project/freez-fiter-pilot-gas-heater/.

First Office Action from Chinese Application No. 201480005227.3, dated Jul. 4, 2016.

Examiner's First Report from Australian Patent Application No. 20150202585, dated Nov. 4, 2018.

Communication pursuant to Rules 161(1) and 162 EPC from European Patent Application No. 14702709.8, dated Aug. 28, 2015.

International Search Report and Written Opinion of PCT/US2014/011780, dated May 13, 2014.

Non-Final Office Action from U.S. Appl. No. 14/409,762, dated Sep. 13, 2017.

Final Office Action from U.S. Appl. No. 14/409,762, dated Oct. 27, 2017.

U.S. Prosecution history of U.S. Appl. No. 11/438,078, filed May 18, 2006.

ZEECO®, Air Assisted Flare AF Series, Brochure, Broken Arrow, OK, 2011, 2 pgs, Zeeco, Inc.

STEFFES Corporation, Air Assisted Flare, Insert, Dickinson, ND (date not available) 2 pgs, Steffes Corp.

John Zink®, Air-Assisted Flaring Systems EEF-LH Series, Bulletin 5103A, Tulsa, OK, 1994, 2 pgs, John Zink Company.

Non-Final Office Action from U.S. Appl. No. 14/705,141, dated May 2, 2017.

* cited by examiner

PILOT GAS PREHEATING FOR A GAS FLARE PILOT BURNER

FIELD

Embodiments of the present disclosure are generally directed to a pilot burner that is configured to burn pilot gas and, more particularly, to a pilot burner that is configured to preheat the pilot gas before igniting the gas.

BACKGROUND

Gas flares are combustible gas burners that are commonly used in industrial plants, such as petroleum refineries, chemical plants, and natural gas processing plants, as well as oil and gas production sites, to combust waste gases, such as volatile organic compounds, methane, sulfur-related compounds and other toxic waste gases and avoid their direct discharge into the atmosphere.

A typical gas flare or flare burner includes a flare stack and a pilot burner. Waste gas is supplied to the flare stack and discharged through a flare tip of the flare stack. The pilot burner is configured to ignite the waste gas at the flare tip.

Conventional pilot burners receive a flow of pilot gas, which is mixed with air at an inspirator at a ratio that promotes ignition and proper burning of the pilot gas. The mixed flow of air and gas is delivered to a pilot output where it is discharged near the flare tip of the gas flare. An igniter ignites the mixed flow discharged through the pilot output, which ignites the waste gas discharged from the flare tip to form the desired flare.

Gas flares are often located in environments that may be subject to extreme environmental conditions. When the gas flare is located in a cold environment, frost (e.g., hoar frost) and/or ice may form at the inspirator from moisture within the pilot gas, moisture in the air, or from snow or rain. The frost or ice may inhibit the flow of the pilot gas and/or the air through the inspirator, which may adversely affect the mixed flow and cause the pilot burner to malfunction.

SUMMARY

Embodiments of the present disclosure are generally directed to a pilot burner for use in igniting a gas flare, methods of operating the pilot burner, and a gas flare that includes the pilot burner. One example of the pilot burner includes a pilot gas supply line, an inspirator, a gas feed line, a pilot output and an igniter. The pilot gas supply line is configured to receive a flow of pilot gas from a pilot gas source. The inspirator receives the flow of pilot gas from the pilot gas supply line and mixes the flow of pilot gas with air to form a mixed flow of air and gas. The gas feed line receives the mixed flow from the inspirator. The pilot output is connected to the gas feed line and discharges the mixed flow. The igniter is configured to ignite the mixed flow discharged through the pilot output to form a flame. The pilot gas supply line includes a gas preheat conduit section that is positioned adjacent to the pilot output and is configured to be heated by the flame.

In one example of a method of operating a pilot burner, in which the pilot burner includes a pilot gas supply line including a gas preheat conduit section, an inspirator, a gas feed line, a pilot output connected to the gas feed line, and an igniter, a flow of pilot gas is delivered from a pilot gas source to the inspirator through the pilot gas supply line. The flow of pilot gas is mixed with air using the inspirator to form a mixed flow of air and gas. The mixed flow is discharged from the pilot output and ignited using the igniter to form a flame at the pilot output. The gas preheat conduit section of the pilot gas supply line and the flow of pilot gas traveling therethrough are heated using the flame.

One example of a gas flare includes a source of waste gas configured to supply a flow of waste gas, a flare body configured to receive the flow of the waste gas at a proximal end, a flare tip at a distal end of the flare body, through which the flow of the waste gas is discharged, and a pilot burner. The pilot burner includes a pilot gas supply line, an inspirator, a gas feed line, a pilot output and an igniter. The pilot gas supply line is configured to receive a flow of pilot gas from a pilot gas source. The inspirator receives the flow of pilot gas from the pilot gas supply line and mixes the flow of pilot gas with air to form a mixed flow of air and gas. The gas feed line receives the mixed flow from the inspirator. The pilot output is connected to the gas feed line and discharges the mixed flow. The igniter is configured to ignite the mixed flow discharged through the pilot output to form a flame. The pilot gas supply line includes a gas preheat conduit section that is positioned adjacent to the pilot output and is configured to be heated by the flame.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
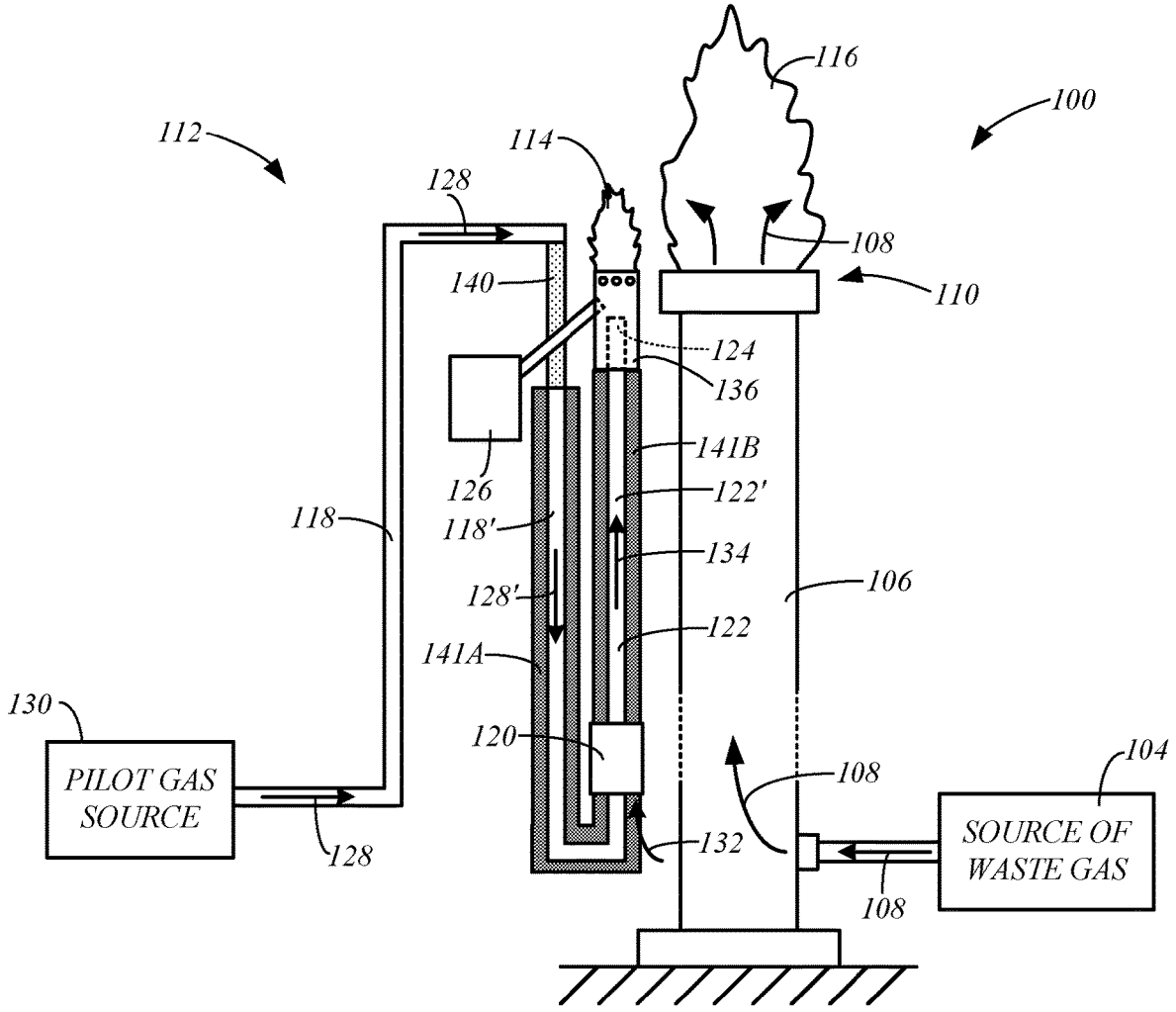
FIG. 1 is a simplified diagram of an example of a gas flare, in accordance embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to only those set forth herein.

Specific details are given in the following description to provide a thorough understanding of embodiments of the present disclosure. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the disclosed embodiments. As used herein, the singular forms "a", "an" and "the" are intended to include the plural forms as well, unless the context clearly indicates otherwise. It will be further understood that the terms "comprises" and/or "comprising." when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the disclosed embodiments of the present disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a simplified diagram of an example of a gas flare or flare burner, in accordance embodiments of the present disclosure. The gas flare 100 may be used, for example, in an industrial plant, such as a petroleum refinery, a chemical plant, and a natural gas processing plant, or in an oil and gas production site, to combust waste gases, such as volatile organic compounds, methane, sulfur-related compounds and other toxic waste gases and avoid their direct discharge into the atmosphere.

The gas flare 100 is generally configured to burn flammable waste gas (e.g., waste gas) supplied from a source 104. In the example shown in FIG. 1, the gas flare 100 includes a flare body 106 that is configured to receive a flow 108 of the waste gas from the source 104 and discharge the flow through a flare tip 110. The flare body 106 may take the form of a flare stack containing various stages, in accordance with conventional gas flares. The flare tip 110 may take on various forms, such as, for example, an open pipe flare tip, as shown in FIG. 1, an air-assisted flare tip, a Coanda flare tip, a high velocity flare tip, or another type of flare tip, such as a flare tip having a rotatable damper disclosed in U.S. Pat. No. 9,970,657.

The gas flare 100 includes a pilot burner 112, formed in accordance with embodiments of the present disclosure. The pilot burner 112 is generally configured to generate a pilot flame 114 that is used to ignite the waste gas 108 discharged through the flare tip 110 to burn the waste gas 108 as indicated by the flame 116. The pilot burner generally includes a pilot gas supply line 118, an inspirator 120, a gas feed line 122, a pilot output 124 and an igniter 126.

The gas supply line 118 is configured to receive a flow 128 of pilot gas from a source 130, such as a tank. The inspirator 120 is configured to receive the flow 128 from the line 118 and mix the flow 128 with air 132 to form a mixed flow 134 of gas and air. The gas feed line 122 receives the mixed flow 134 from the inspirator 120 and delivers the mixed flow 134 to the pilot output 124. The igniter 126 is configured to ignite the mixed flow 134 discharged through the pilot output 124 to form the flame 114. A nozzle guard 136 may surround the pilot output 124 and assist in allowing the discharged pilot gas flow 108 to be ignited by the igniter 126 and preventing the flame 114 from being blown out by wind.

A controller (not shown) may be used to control valves for controlling the flow of pilot gas 128 and the igniter 126 to produce the flame 114, such as based on a temperature signals from a temperature sensor located near the pilot output 124, for example. These and other aspects of the pilot burner 112 may be in accordance with conventional pilot burners used in gas flares 100.

As mentioned above, the gas flare 100 may be located where it may be subject to extreme environmental conditions, such as extremely cold conditions, such as below-zero degrees Fahrenheit (e.g., −20-40° F.). When subjected to such cold conditions, frost and/or ice may form at the inspirator 120 (e.g., at orifice of the inspirator) from moisture within the pilot gas, moisture in the air, or from snow or rain. The frost or ice may inhibit the pilot gas flow 128 and/or the air flow 132 through the inspirator 120, which may result in a mixed flow 134 having an improper ratio of pilot gas and air and cause the pilot burner 112 to malfunction. Such a malfunction of the pilot burner 112 may prevent the generation of the flame 114 and the ignition of the waste gas flow 108 through the flare tip 110. As a result, the waste gas flow 108 may be directly released into the air.

Embodiments of present disclosure are directed to prevent problems of ice and/or frost buildup at the inspirator 120. In some embodiments, the pilot burner 112 operates to heat the pilot gas flow 128 delivered to and through the inspirator 120 to a temperature that prevents the buildup of ice and/or frost at the inspirator, thus allowing the pilot burner 112 to operate under conditions where conventional pilot burners malfunction. A wind guard may be placed around the insulator 120 to block the wind and insulate the inspirator.

In some embodiments, the gas supply line 118, which feeds the pilot gas flow 128 to the inspirator 120, is heated at a location that is upstream of the inspirator 120. This preheats the pilot gas flow 128 to a temperature that is above freezing. When the preheated pilot gas flow 128 travels through the inspirator 120, it prevents the buildup of frost and/or ice that would normally inhibit its flow 128 and/or the air flow 132 through the inspirator 120. As a result, the inspirator 120 generates the mixed flow 134 having the desired ratio of pilot gas and air, which facilitates its proper ignition and the critical formation of the flame 114.

In one example, the supply line 118 includes a gas preheat conduit section 140 that is positioned adjacent to the pilot output and is configured to be heated by the pilot flame 114, as indicated in FIG. 1. For example, the conduit section 140 may be separated from the flame 114 by less than 2 feet, such as less than 15 inches, or less than 5 inches, for example. The close proximity of the conduit section heats the supply line 118, which may be formed of stainless steel, which in turn heats the pilot gas flow 128. The heated pilot gas flow 128' that is discharged from the conduit section 140 is delivered to the inspirator 120 where it heats components of the inspirator 120 above freezing and prevents the buildup of frost and/or ice.

Heat generated by the flame 114 may be used to heat the conduit section 140 using various techniques. In some embodiments, the conduit section 140 or a portion thereof may be directly heated by the flame by placing the conduit section 140 in the flame 114, or by placing the conduit section 140 in a position where it directly receives radiant heat energy from the flame 114, such as shown in FIG. 1. In some embodiments, the conduit section 140 or a portion thereof may be indirectly heated by the flame 114 by conducting or radiating heat energy generated by the flame to the conduit section 140 through one or more intermediary components that are directly heated by the flame 114, such as the nozzle guard 136, for example.

A portion 118' of the gas supply line 118 extending between the conduit section 140 and the inspirator 120 may be covered by a thermal insulator 141A and/or a portion 122' of the gas feed line 122 may be covered by a thermal insulator 141B. The thermal insulator 141A insulating the portion 118' inhibits cooling of the heated pilot gas flow 128' as it travels to the inspirator 120. The thermal insulator 141B inhibits cooling of the mixed flow 134 as it travels to the pilot output 124.

The thermal insulators 141 may take on any suitable form. One example of the thermal insulators 141 includes insulation, such as a silica based high temperature insulation. Such insulation may be used to cover both portions 118' and 122'. In another example, the thermal insulators 141 may be integrated into the gas supply line 118 and/or the gas feed line 122 by forming the lines using double walled, vacuum insulated stainless steel tubing. Other suitable forms of the thermal insulators 141 may also be used.

Figure 2:
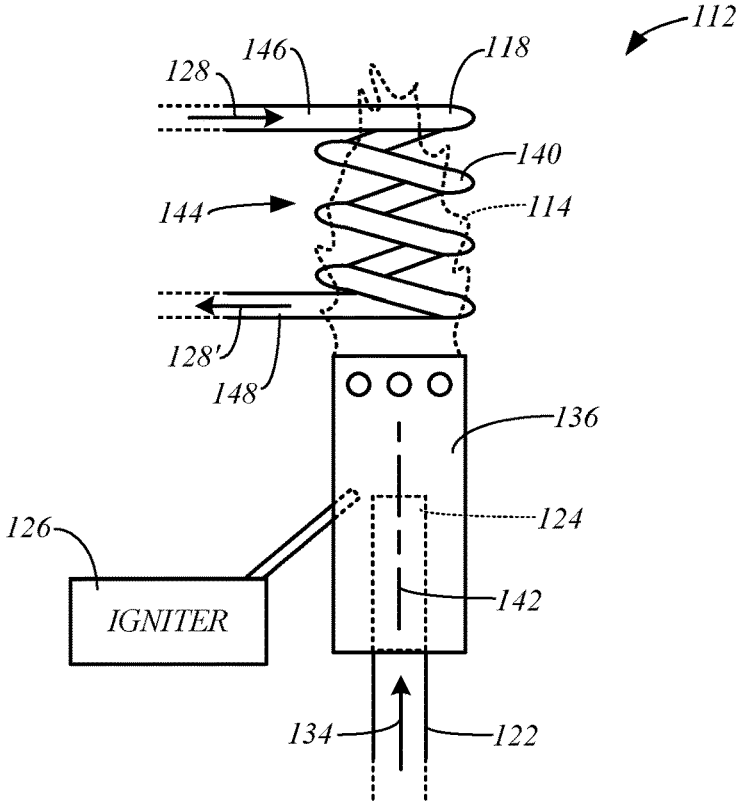
FIG. 2 is a simplified side view of a portion of an example of a pilot burner, in accordance with embodiments of the present disclosure.

FIG. 2 is a simplified side view of a portion of an example of the pilot burner 112, in accordance with embodiments of the present disclosure. In the illustrated example, the gas preheat conduit section 140 includes a portion that extends into a region where the flame 114 forms, such as along an axis 142 of the gas feed line 122 above the pilot output 124, for example. Thus, when the mixed flow 134 is ignited by the igniter 126, the conduit section 140 extends into the flame 114, thereby heating the conduit section 140 and the pilot gas flow 128 to form the preheated pilot gas flow 128'.

Figure 3:
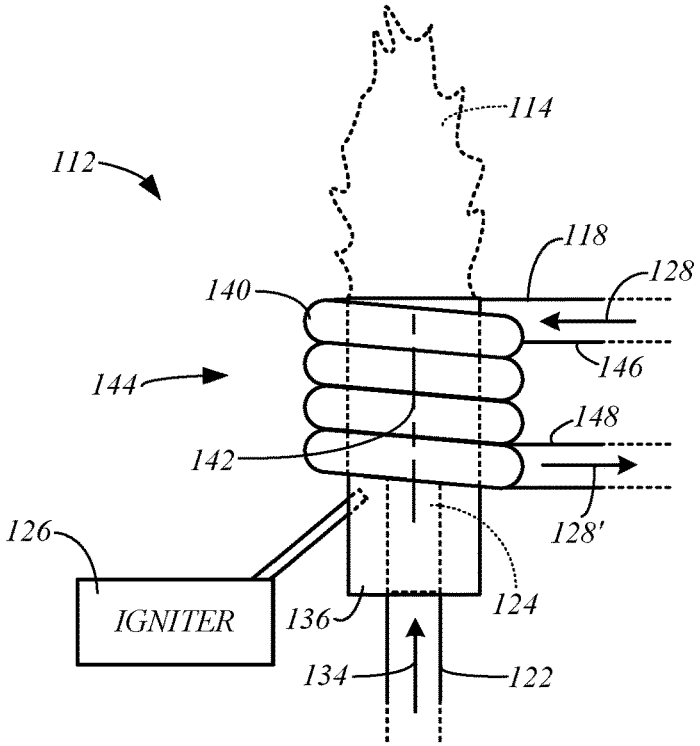
FIG. 3 is a simplified side view of a portion of an example of a pilot burner, in accordance with embodiments of the present disclosure.

FIG. 3 is a simplified side view of a portion of an example of the pilot burner 112, in accordance with embodiments of the present disclosure. In the illustrated example, the gas preheat conduit section 140 includes a portion that is attached to, engages or is positioned in close proximity to the nozzle guard 136. Accordingly, the conduit section may receive heat energy from the flame 114 that is conducted to the conduit section 114 through engagement with the nozzle guard 136 and/or radiantly transmitted to the conduit section 114 from the nozzle guard 136, for example. The conduit section 140 may also receive heat directly from the flame 114.

In one embodiment, the conduit section 140 extends alongside the nozzle guard 136, such as shown in FIGS. 1 and 3. Here, the conduit section 140 may extend or wrap around the nozzle guard 136, as shown in FIG. 3.

The conduit section 140 may include a coiled section 144. The coiled section 144 may extend into the flame 114, as shown in FIG. 2, or extend around the nozzle guard 136, as shown in FIG. 3, for example. The coiled section 144 may extend along the axis 142. The coiled section 144 may be substantially concentric (e.g., +/−1 inch) to the axis 142, as indicated in FIGS. 2 and 3.

In one embodiment, the coiled section 144 includes an input end 146 that receives the pilot gas flow 128, and an output end 148 through which the preheated pilot gas flow 128' is discharged. In one embodiment, the input end 146 is displaced farther along the axis 142 than the output end 148 from the flame 114, as shown in FIG. 3. In other embodiments, this arrangement may be reversed.

Figure 4:
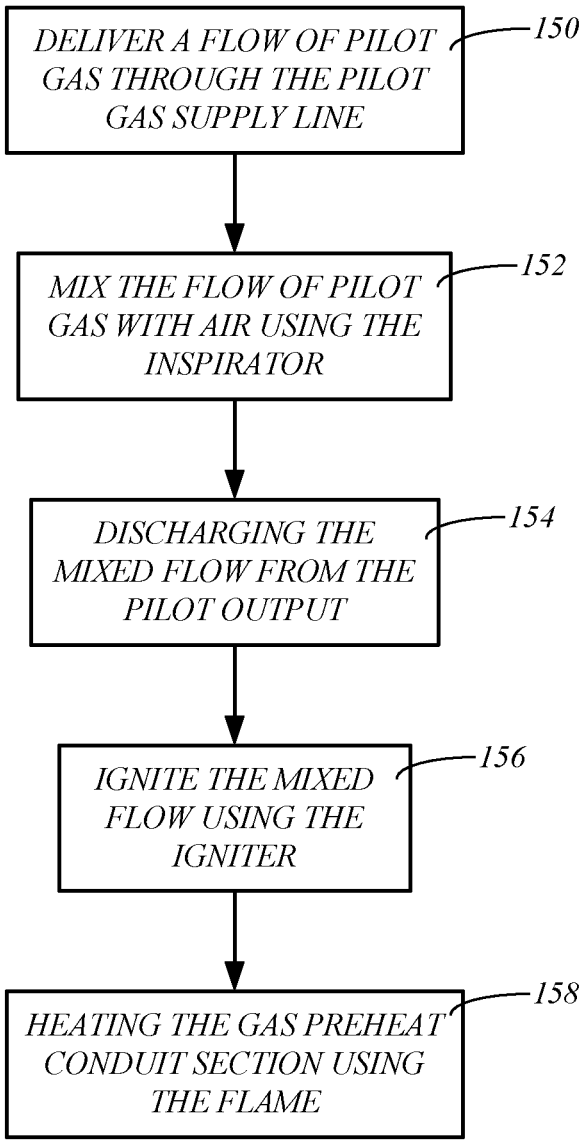
FIG. 4 is a flowchart illustrating a method of operating a pilot burner, in accordance with embodiments of the present disclosure.

FIG. 4 is a flowchart illustrating a method of operating a pilot burner 112, formed in accordance with one or more embodiments described herein. At 150 of the method, a flow 128 of pilot gas is delivered through the gas supply line 118. At 152, the pilot gas flow 128 is mixed with a flow 132 of air using the inspirator 120, which discharges a mixed flow 134 of air and gas. The mixed flow 134 is delivered to and discharged from the pilot output 124, at 154. At 156, the mixed flow 134 is ignited using the igniter 126 to form the flame 114. At 158, the flame 114 is used to heat the gas preheat conduit section 140 of the supply line 118. As a result, a preheated pilot gas flow 128' is delivered to the inspirator 120. The preheated pilot gas flow 128' may be used to prevent and/or melt frost and/or ice at the inspirator 120.

Although embodiments of the present disclosure have been described with reference to preferred embodiments, workers skilled in the art will recognize that changes may be made in form and detail without departing from the spirit and scope of the disclosed embodiments. For example, while the disclosed embodiments have been directed to a pilot burner of a gas flare, it is understood that the disclosed embodiments may be useful in other types of pilot burners that may be subjected to very cold environments and may benefit from the pilot gas preheating features described herein.

What is claimed is:

1. A pilot burner for igniting a gas flare comprising:
- a pilot gas supply line configured to receive a flow of pilot gas from a pilot gas source;
- an inspirator configured to receive the flow of pilot gas from the pilot gas supply line and mix the flow of pilot gas with air to form a mixed flow of air and gas;
- a gas feed line configured to receive the mixed flow from the inspirator;
- a pilot output connected to the gas feed line and configured to discharge the mixed flow; and
- an igniter configured to ignite the mixed flow discharged through the pilot output to form a flame at the pilot output, wherein:
- the pilot gas supply line includes a gas preheat conduit section that is positioned adjacent to the pilot output and is configured to be heated by the flame;
- the pilot burner includes a nozzle guard that surrounds a portion of the gas feed line and the pilot output;
- the gas preheat conduit section includes a coiled section that extends alongside and around the nozzle guard; and
- one or more thermal insulators cover a portion of the pilot gas supply line extending between the gas preheat conduit section and the inspirator and/or a portion of the gas feed line.

2. The pilot burner according to claim 1, wherein the gas preheat conduit section is positioned within 15 inches of the pilot output.

3. The pilot burner according to claim 1, wherein the gas preheat conduit section is indirectly heated by the flame.

4. The pilot burner according to claim 1, wherein heat energy from the flame is conducted to the gas preheat conduit section.

5. The pilot burner according to claim 1, wherein heat energy from the flame is radiated to the gas preheat conduit.

6. The pilot burner according to claim 1, wherein the coiled section extends along a central axis of the nozzle guard.

7. The pilot burner according to claim 6, wherein:
- the coiled section includes an input end that receives the flow of pilot gas, and an output end at which the flow of pilot gas is discharged;
- the output end is connected to the inspirator; and
- the input end is positioned closer to the flame than the output end.

8. A gas flare comprising:
- a source of waste gas configured to supply a flow of waste gas;
- a flare body configured to receive the flow of the waste gas at a proximal end;
- a flare tip at a distal end of the flare body; and the pilot burner according to claim 1, wherein the pilot output is positioned adjacent to the flare tip.

9. A method of operating a pilot burner for use with a gas flare, the pilot burner including:

a pilot gas supply line including a gas preheat conduit section;

an inspirator;

a gas feed line;

a pilot output connected to the gas feed line; and an igniter, the method comprising:

delivering a flow of pilot gas from a pilot gas source to the inspirator through the pilot gas supply line;

mixing the flow of pilot gas with air using the inspirator to form a mixed flow of air and gas;

discharging the mixed flow from the pilot output;

igniting the discharged mixed flow using the igniter to form a flame at the pilot output; and heating the gas preheat conduit section of the pilot gas supply line and the flow of pilot gas traveling therethrough using the flame, wherein:

the pilot burner includes a nozzle guard that surrounds a portion of the gas feed line and the pilot output;

the gas preheat conduit section includes a coiled section that extends alongside and around the nozzle guard; and one or more thermal insulators cover a portion of the pilot gas supply line extending between the gas preheat conduit section and the inspirator and/or a portion of the gas feed line.

10. The method according to claim 9, wherein the gas preheat conduit section is positioned within 15 inches of the pilot output.

11. The method according to claim 9, wherein the gas preheat conduit section extends within the flame and heating the flow of pilot gas includes directly heating the gas preheat conduit section using the flame.

12. The method according to claim 9, wherein heating the gas preheat conduit section includes:

radiantly heating the gas preheat conduit section using the heat energy; and/or conducting the heat energy to the gas preheat conduit section.

13. A gas flare comprising:

a source of waste gas configured to supply a flow of waste gas;

a flare body configured to receive the flow of the waste gas at a proximal end;

a flare tip at a distal end of the flare body, through which the flow of the waste gas is discharged; and a pilot burner comprising:

a pilot gas supply line configured to receive a flow of pilot gas from a pilot gas source;

an inspirator configured to receive the flow of pilot gas from the pilot gas supply line and mix the flow of pilot gas with air to form a mixed flow of air and gas;

a gas feed line configured to receive the mixed flow from the inspirator;

a pilot output connected to the gas feed line and configured to discharge the mixed flow; and an igniter configured to ignite the mixed flow discharged through the pilot output to form a flame at the pilot output, which is configured to ignite the flow of the waste gas at the flare tip, wherein:

the pilot gas supply line includes a gas preheat conduit section that is positioned adjacent to the pilot output and is configured to be heated by the flame;

the pilot burner includes a nozzle guard that surrounds a portion of the gas feed line and the pilot output;

the gas preheat conduit section includes a coiled section that extends alongside and around the nozzle guard; and one or more thermal insulators cover a portion of the pilot gas supply line extending between the gas preheat conduit section and the inspirator and/or a portion of the gas feed line.

* * * * *